US012345438B2

(12) United States Patent
Byers

(10) Patent No.: US 12,345,438 B2
(45) Date of Patent: Jul. 1, 2025

(54) VENT COVER ASSEMBLY

(71) Applicant: Shane L. Byers, Portland, OR (US)

(72) Inventor: Shane L. Byers, Portland, OR (US)

( * ) Notice: Subject to any disclaimer, the term of this patent is extended or adjusted under 35 U.S.C. 154(b) by 451 days.

(21) Appl. No.: 17/942,483

(22) Filed: Sep. 12, 2022

(65) Prior Publication Data

US 2023/0160602 A1 May 25, 2023

Related U.S. Application Data

(60) Provisional application No. 63/281,715, filed on Nov. 21, 2021.

(51) Int. Cl.

| | |
|---|---|
| ***F24F 13/08*** | (2006.01) |
| ***E04B 1/70*** | (2006.01) |
| ***F24F 7/00*** | (2021.01) |

(52) U.S. Cl.

CPC ..... *F24F 13/084* (2013.01); *E04B 1/7076* (2013.01); *F24F 7/00* (2013.01); *F24F 2007/0025* (2021.01)

(58) Field of Classification Search

CPC ..... F24F 13/082; F24F 13/084; F24F 2007/0025; F24F 2221/52; E04B 1/7076

USPC ..... 454/271

See application file for complete search history.

(56) References Cited

U.S. PATENT DOCUMENTS

| | | | | |
|---|---|---|---|---|
| 14,680 A | | 4/1856 | Titus | |
| 88,386 A | | 3/1869 | Hoyt et al. | |
| 2,127,072 A | * | 8/1938 | Tinnerman | B60K 11/04 24/453 |
| 2,843,035 A | * | 7/1958 | Jacks | E04F 19/08 454/276 |
| 3,130,659 A | | 4/1964 | Compton et al. | |
| 3,507,206 A | | 4/1970 | Olson, Jr. | |
| D244,539 S | | 5/1977 | Mulligan | |
| 4,469,018 A | | 9/1984 | Taulman | |
| 4,502,368 A | | 3/1985 | Hempel | |
| 5,192,244 A | | 3/1993 | Rose | |
| 5,479,984 A | | 1/1996 | Easterbrook et al. | |
| 5,759,098 A | | 6/1998 | Jarnot | |
| 6,050,893 A | | 4/2000 | Waite | |
| 6,149,514 A | | 11/2000 | Maury | |
| 6,558,248 B1 | | 5/2003 | Moore, Jr. et al. | |
| 6,601,352 B1 | | 8/2003 | Obermeyer et al. | |
| 6,749,499 B1 | | 6/2004 | Snyder | |
| 6,776,709 B1 | | 8/2004 | Moore, Jr. et al. | |
| 7,040,979 B1 | | 5/2006 | Betz | |
| 7,413,024 B1 | | 8/2008 | Simontacchi et al. | |
| 7,556,560 B2 | | 7/2009 | Janesky | |

(Continued)

*Primary Examiner* — Allen R. B. Schult

(57) ABSTRACT

A vent cover assembly to cover an opening in a crawl space vent includes a vent cover having upper and lower surfaces, an outer perimeter and a planar clip. The vent cover includes a slit positioned through the upper and lower surfaces of the vent cover to receive the clip. The clip has a ring portion and a first leg and a second leg extending therefrom. The first and second legs are configured to be slidably inserted through the slit of the vent cover. The first and second legs of the clip are positioned and configured to receive therebetween a portion of a vertically positioned central wall of the crawl space vent. The central wall is frictionally griped between the first and second legs of the clip, and the inner surface of the vent cover is simultaneously positioned over an outer perimeter of the vent to close the vent.

20 Claims, 5 Drawing Sheets

(56) References Cited

U.S. PATENT DOCUMENTS

| | | | |
|---|---|---|---|
| D607,098 | S | 12/2009 | Sykes |
| 7,707,789 | B2 | 5/2010 | Janesky |
| 7,794,313 | B2 | 9/2010 | Ruberg |
| 7,980,035 | B1 | 7/2011 | D'Apolito et al. |
| D652,907 | S | 1/2012 | Andrews |
| D654,162 | S | 2/2012 | Sykes |
| 8,499,497 | B1 | 8/2013 | Hugueley |
| 10,113,309 | B2 | 10/2018 | Anderson, Jr. et al. |
| 10,969,137 | B2 | 4/2021 | Magyari |
| 2002/0069599 | A1 | 6/2002 | Dhallan |
| 2002/0077059 | A1 | 6/2002 | Rutler et al. |
| 2005/0143002 | A1 | 6/2005 | Orendorff |
| 2013/0331023 | A1 | 12/2013 | Yalmeh |
| 2020/0326098 | A1 | 10/2020 | Warner |

* cited by examiner

VENT COVER ASSEMBLY

CROSS REFERENCE TO RELATED APPLICATIONS

The present non-provisional utility patent application claims the benefit of provisional utility patent application U.S. Ser. No. 63/281,715, entitled VENT COVER ASSEMBLY, filed Nov. 11, 2021, which is hereby incorporated by reference in its entirety.

FIELD OF THE INVENTION

The invention relates to vent cover devices and more particularly pertains to a new vent cover device for covering a crawl space vent to insulate the crawl space during cold weather and/or hot weather to control temperature and/or moisture content of the crawl space.

BACKGROUND

Vent covers have been used to cover crawl space vents for years. Usually, such vent covers are used to cover crawl space vents primarily in the winter, to avoid freezing temperatures that would affect plumbing, cause leaking or breakage of water pipes, and cause increased energy costs. However, in some wet environments and hot environments, vent covers are used periodically year around, to control or prevent moisture and moist air in crawl spaces which could encourage the growth of mold, mildew, and other substances.

Many crawl space vent covers extend beyond an outer perimeter edge of a vent, and over a portion of an outer surface of an outer wall of the building or home. These vent covers are often unattractive and affect the curb appeal of a home or commercial building. Other vent covers are formed from Styrofoam, and break apart, crumble away, or are so light weight that they are blown off of the vent during wind and/or rain. Further, most vent covers must interlock to a portion of the vent, at a number of areas of the vent, such as by hooks, screws, adhesive, and the like, making them difficult to both apply and remove. What is needed is a long lasting vent cover assembly that covers only the vent, is held against the vent easily at one area of the vent cover and the vent and which is easy to apply to cover the vent and equally easy to remove from the vent.

SUMMARY OF THE INVENTION

In one embodiment of the invention, a vent cover assembly adapted to cover a crawl space vent, the vent cover assembly comprising a vent cover having an outer surface, an inner surface, and a perimeter edge that extends around the vent cover. The vent cover includes a slit positioned in and extending through the vent cover between the outer surface and the inner surface. The slit is positioned in a median position of the vent cover. The vent cover assembly also includes a planar clip having a ring portion and a first leg and a second leg extending from the ring portion. The first leg and the second leg are both configured to be slidably inserted through the slit of the vent cover. Only a portion of the ring portion is configured to extend into the slit. When the vent cover assembly is positioned in front of a vent and the clip is inserted into the slit, a portion of the ring portion extends into the slit and is held in a fixed position within a perimeter of the slit, while another portion of the ring portion is configured to extend away from the slit and the outer surface of the vent cover. The first leg and the second leg are configured to extend through the slit and a distance away from the inner surface of the vent cover. The first leg and the second leg of the clip are positioned to receive a portion of a vertically positioned central wall of the vent between the first leg and the second leg. When the vent cover is moved in alignment with an outer perimeter of the vent, the first leg and second leg of the clip are pushed against the center wall, such that at least a portion of the first leg and at least a portion of the second leg frictionally grip firmly but releasably the portion of the central wall positioned between the first leg and the second leg. The inner surface of the vent cover is simultaneously positioned against an outer peripheral edge of the vent to cover the vent. The clip holds the vent cover in a closed position over the vent. The vent cover is configured to extend over but not substantially beyond the outer perimeter of the vent.

In an aspect of the one embodiment of the invention, the perimeter of the vent cover includes a first elongated edge and a second elongated edge positioned parallel relative to each other, and a first end edge and a second end edge positioned parallel relative to each other. The slit is positioned parallel to the first elongated edge and the second elongated edge.

And in an aspect of the one embodiment of the invention, the clip is positioned in the slit such that the ring portion extends a distance from the outer surface of the vent cover and the ring portion is positioned parallel to the first elongated edge and the second elongated edge of the vent cover.

Further, in an aspect of the one embodiment of the invention, the portion of the first leg is a straight portion and the portion of the second leg is sinusoidally shaped and formed to include at least one v-shaped portion, and wherein the ring portion urges the first leg and the second leg toward each other.

addition, in an aspect of the one embodiment of the invention, the straight portion of the first leg and the at least one v-shaped portion of the second leg frictionally grip the central wall of the vent when the central wall is positioned between the straight portion and the at least one v-shaped portion.

Also, in an aspect of the one embodiment of the invention, no portion of the clip interlocks with a portion of the vent.

Moreover, in an aspect of the one embodiment of the invention, the first leg and the second leg includes a first end and a second end, respectively, and at least one end of the first end and the second end is spaced away from the other to receive the central wall between the first end and the second end.

And in an aspect of the one embodiment of the invention, the vent cover is formed from an environmentally friendly material certified by at least one certification authority, and the vent cover is formed from a solid and non-metallic material.

Also, in an aspect of the one embodiment of the invention, the vent cover assembly includes at least one vent filler.

Further, in an aspect of the one embodiment of the invention, the vent cover assembly is removable from the vent when the ring portion of the clip is pulled away from the vent, which moves the first leg and the second leg away from the vertical central wall to release the frictional grip thereon, and simultaneously moves the vent cover away from the vent.

In another embodiment of the invention, a method of applying a vent cover assembly to a crawl space vent, comprises providing a vent cover assembly which includes a vent cover having an outer surface, an inner surface and a perimeter edge extending around the vent cover. The vent cover includes a slit positioned in a median area and the slit extends through the vent cover between the outer surface and the inner surface. The vent cover assembly also including a planar clip having a ring portion and a first leg and a second leg. A first portion of the ring portion and the first leg and the second leg are both configured to be slidably inserted through the slit. The method also includes positioning the vent cover in front of a crawl space vent having a center vertical wall. The method further includes inserting the clip into the slit. The first portion of the ring portion configured to extend into the slit and is held in a fixed position. A second portion of the ring portion is configured to extend away from the slit and the outer surface of the vent cover. The first leg and second leg extend through and a distance away from the slit and the inner surface of the vent cover. In addition, the method includes contacting a front edge of a vertical center wall of the vent with the first leg and the second leg. Moreover, the method includes aligning the vent cover with an outer perimeter of the vent. And the method includes pushing the clip and the vent cover toward the vent simultaneously, such that the central wall is received between the first leg and the second leg. The first leg and the second leg are urged by the ring portion toward each other such that the first leg and the second leg frictionally grip the center wall. The inner surface of the vent cover is moved against the outer peripheral edge of the vent to cover the vent, and the vent cover is configured to not extend substantially beyond the vent.

In one aspect of the embodiment of the invention, in the step of providing a vent cover assembly, the outer perimeter of the vent cover further includes a first elongated edge, and a second elongated edge positioned parallel relative to each other, and a first end edge and a second end edge positioned parallel relative to each other. The slit is formed in a median area of the vent cover, and the slit is parallel relative to the first elongated edge and the second elongated edge.

And in an aspect if the other embodiment of the invention, the clip is positioned in the slit such that the ring portion is positioned parallel to the first elongated edge and the second elongated edge of the vent cover.

In addition, in an aspect if the other embodiment of the invention, a portion of the first leg is a straight portion and a portion of the second leg is sinusoidally shaped and formed to include at least one v-shaped portion.

Further, in an aspect if the other embodiment of the invention, the straight portion of the first leg and the at least one v-shaped portion of the second leg frictionally grip the center wall of the vent when the center wall is positioned therebetween.

Moreover, in an aspect if the other embodiment of the invention, no portion of the clip interlocks with a portion of the vent.

In addition, in an aspect if the other embodiment of the invention, the first leg and the second leg include a first end and a second end, respectively, and at least one end of the first end and the second end is spaced away relative to the other to receive the central wall between the first and the second end.

And in an aspect if the other embodiment of the invention, the vent cover is formed from an environmentally friendly material certified by at least one certification authority, and the vent cover is formed from a solid and non-metallic material.

Further, in an aspect if the other embodiment of the invention, the vent cover assembly includes at least one vent filler.

Moreover, in an aspect if the other embodiment of the invention, the method further includes the step of removing the vent cover assembly from the vent by pulling the ring portion of the clip positioned on the outer surface of the vent cover away from the vent, and slidably moving the first leg and the second leg away from the central wall to release the frictional grip thereon, such that moving the clip results in simultaneously moving the vent cover away from the vent.

BRIEF DESCRIPTION OF THE DRAWINGS

The disclosure will be better understood and features set forth above will become apparent when consideration is given to the following detailed description thereof. Such description makes reference to the annexed drawings wherein.

DETAILED DESCRIPTION

Figure 1:
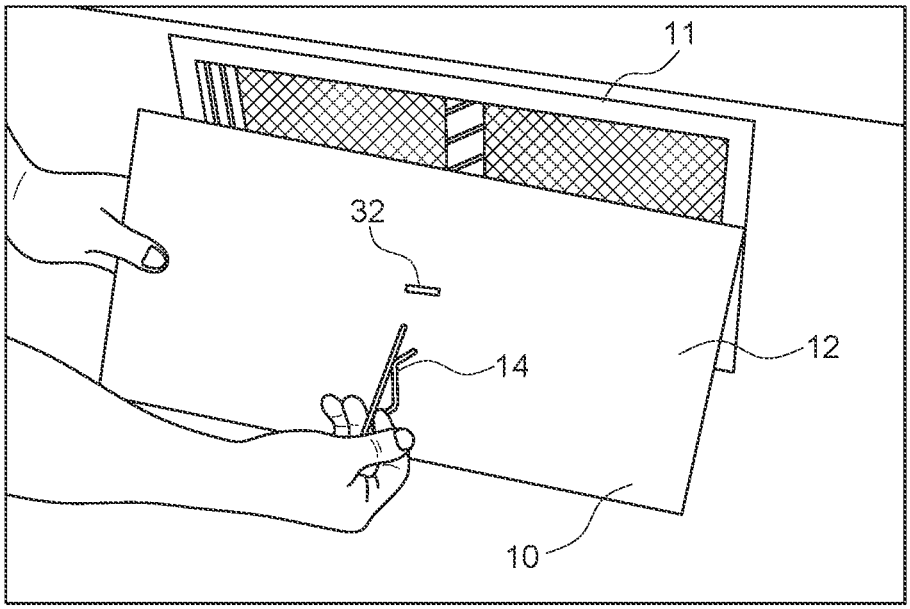
FIG. 1 is a top perspective view of a crawl space vent cover assembly according to the present invention, illustrating a portion of a crawl space vent and the vent cover assembly including a vent cover and a clip.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
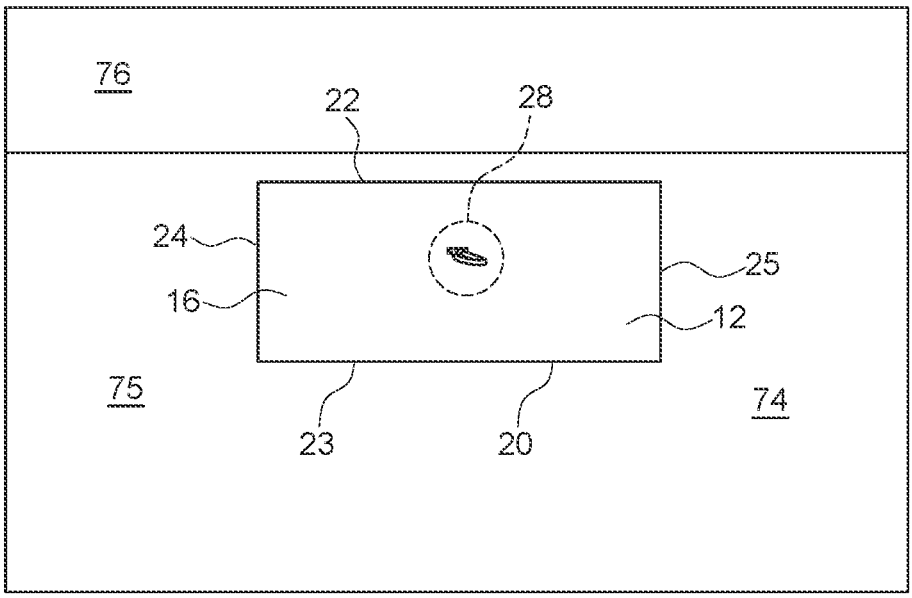
FIG. 2 is a side elevational view of the vent cover assembly of FIG. 1 with the clip connected to the crawl space vent.
Figure 3A:
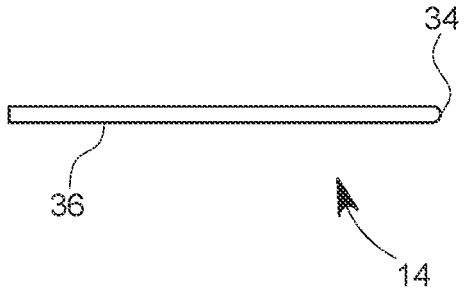
FIG. 3 is a side view of the clip of FIG. 1, illustrating the planar configuration thereof.
Figure 3B:
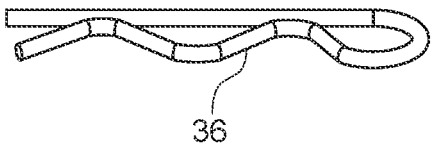

In general, and with reference to FIGS. 1 and 2, the present subject matter is directed to a new vent cover assembly 10 for a crawl space vent 11. The vent cover assembly 10 includes a vent cover 12 and a clip 14.

The vent cover 10 includes an outer surface 16, an inner surface 18, and a perimeter edge 20. The outer surface 16 and the inner surface 18 are planar and parallel relative to each other. The perimeter edge 20 may include two elongated edges which are spaced-apart and parallel to each other, namely, first and second elongated edges 22, 23. The perimeter edge 20 also includes two spaced-apart first and second end edges 24, 26, that are also parallel to each other, so that the vent cover is preferably, but not by way of limitation, a rectangular shape. The vent cover desirable has a thickness in a range of one eighth (⅛) inch to one and one-half (1.5) inches. Alternatively, the thickness may be in a range of one eighth (⅛) inch to one (1) inch. In yet another alternative, the thickness may be in a range of one eighth (⅛) inch to ⅝ inch.

An aperture forming an elongated slit 32 is desirably positioned in a median section 28 of the vent cover 12, as shown in FIG. 2. The elongated slit 32 is may be horizontally aligned with the first and second elongated edges 22, 23. The slit 32 extends through the outer and inner surfaces 16, 18 of the vent cover 12.

The vent cover 12 is formed from a durable material that is eco-friendly. The vent cover 12 is made from post-consumer products that are recyclable at the end of their useful life. Each vent cover 12 has high durability and resistance to most damage, dents, scratches and will never rust. The vent cover is also resistant to insects, graffiti, mold and bacteria. The material for the vent cover is a polymer material, manufactured and/or sold by, for example, King Plastic Corporation, Florida.

The vent cover 12 is environmentally stabilized to withstand the harshest weather conditions, and will not warp, rot, and delamination resistant when exposed to humidity or water. The vent cover 12 is formed from a material that will not break down under exposure to sunlight or extremes of heating or freezing.

There are no harmful emissions produced during the production of the vent cover 12 or during its use by a consumer. The material of the vent cover 12 does not leak toxic chemicals into the soil or water. Manufacturing of each vent cover 12 requires only a fraction of the energy required to produce steel from iron ore, further contributing to its classification of being eco-friendly. The vent cover 12 is made entirely from FDA and USDA approved material and it does not contain phthalates, heavy metals or allergens. The vent cover 12 has a working temperature of minus 20 degrees Fahrenheit to 120 degrees Fahrenheit.

The vent cover 12 is made from a tough, strong material that is used in a wide variety of applications, for example, but not by way of limitation, to store water, to store food (the material meets all US FDA requirements) to be used in commercial applications, and the like. The material of the vent cover has a GREENGUARD™ Gold Certification. GREENGUARD™ Gold Certification (formerly known as GREENGUARD™ Children & Schools Certification) offers stricter certification criteria, considers safety factors to account for sensitive individuals (such as children and the elderly), and ensures that a product is acceptable for use in environments such as schools and healthcare facilities. It is referenced by both The Collaborative for High Performance Schools (CHPS) and the Leadership in Energy and Environmental Design (HEED) Building Rating System.

The clip 14 of the vent cover assembly 10, as illustrated in FIGS. 1, 2, 3 and 6-8, may be made from metal and it is substantially planar. The clip includes an opened ring or other shaped portion 34 having a straight first leg 36 and a sinusoidal second leg 38, both legs 36, 38 extending away from the ring portion 34 of the clip 14. The ring portion 34 is configured to act as a spring relative to urging the straight first leg 36 and the sinusoidal second leg 38 together in a position touching each other. The straight first leg 36 and the sinusoidal second leg 38 each have ends 40, 42, respectively. The end 42 of the sinusoidal second leg 38 is positioned away from the end 40 of the straight first leg 38. It will be appreciated that the straight first leg 38 may also have curved areas and the like, and the present embodiment is meant as an example, and not a limitation thereof. The sinusoidal second leg 38 desirably includes at least one v-shaped portion, and in the present embodiment, for example, but not by way of limitation, two v-shaped portions 44, 46 are illustrated in the sinusoidal curvature of the clip 14 that are positioned frictionally against the straight first leg 38. The position of the ends 40, 42 of the straight first leg and the sinusoidal second leg permits an object to be introduced between the ends, 40, 42 so that such an object will be frictionally gripped as it is moved between the straight first leg 36 and the sinusoidal second leg 38. The clip 14 may be formed from metal, plastic, or combinations thereof. It will be understood that the ring portion 34 does not necessarily need to be a ring, and may be any shape or combination of shapes so long as it functions as shown and described herein like the ring portion 34. It will be appreciated that any material may be used for the clip so long as the clip functions as shown and/or described herein. Clips 14 are available from Zoro Tools, Inc., Illinois.

Figure 4:
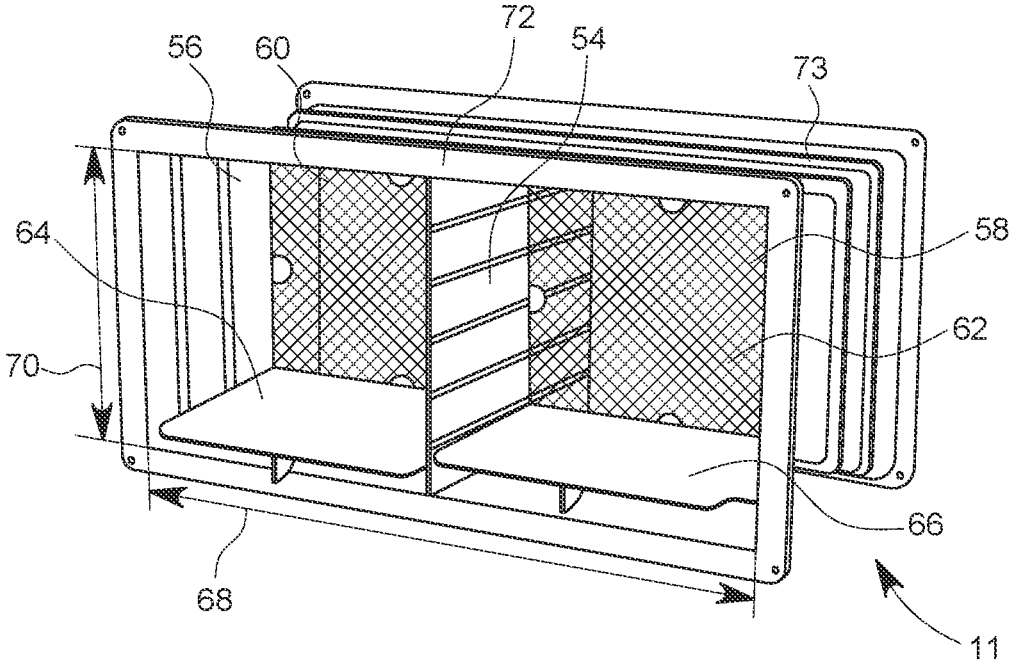
FIG. 4 is a perspective view of a crawl space vent, showing a center vertical wall therein.
Figure 5:
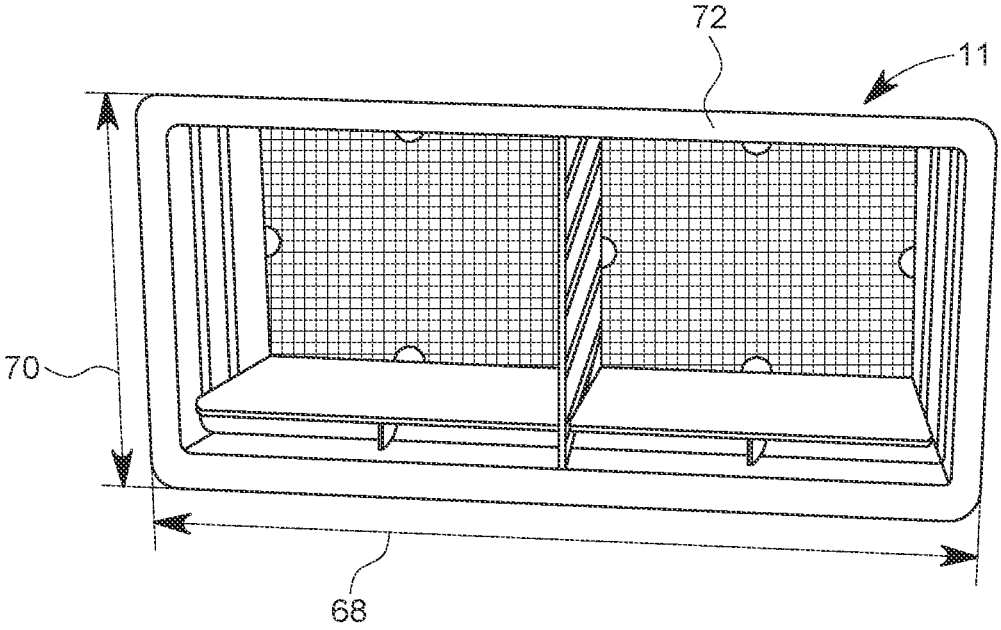
FIG. 5 is perspective view of crawl space vent similar to that of FIG. 1 and FIG. 4, illustrating the center vertical wall therein.
Figure 6:
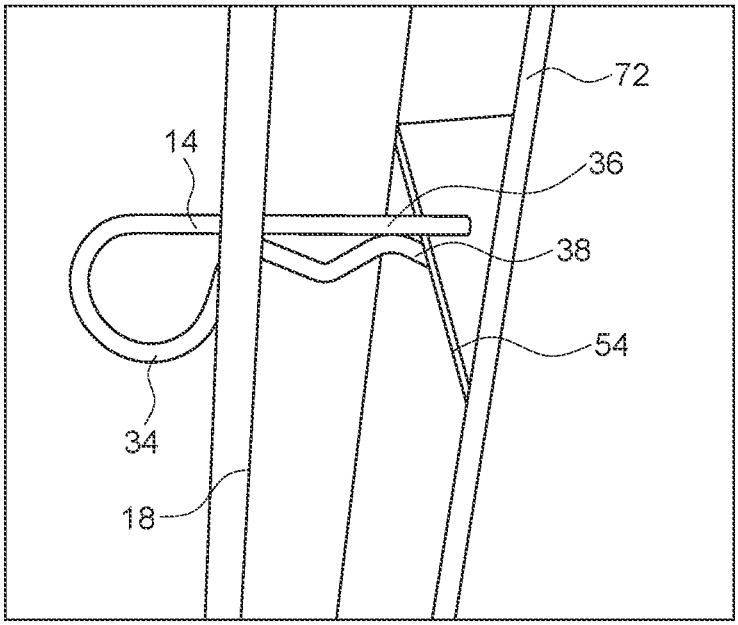
FIG. 6 is an upper perspective view of the vent cover, the clip, and the crawl space vent, the clip connected to the vent cover and the clip contacting the center wall.
Figure 7:
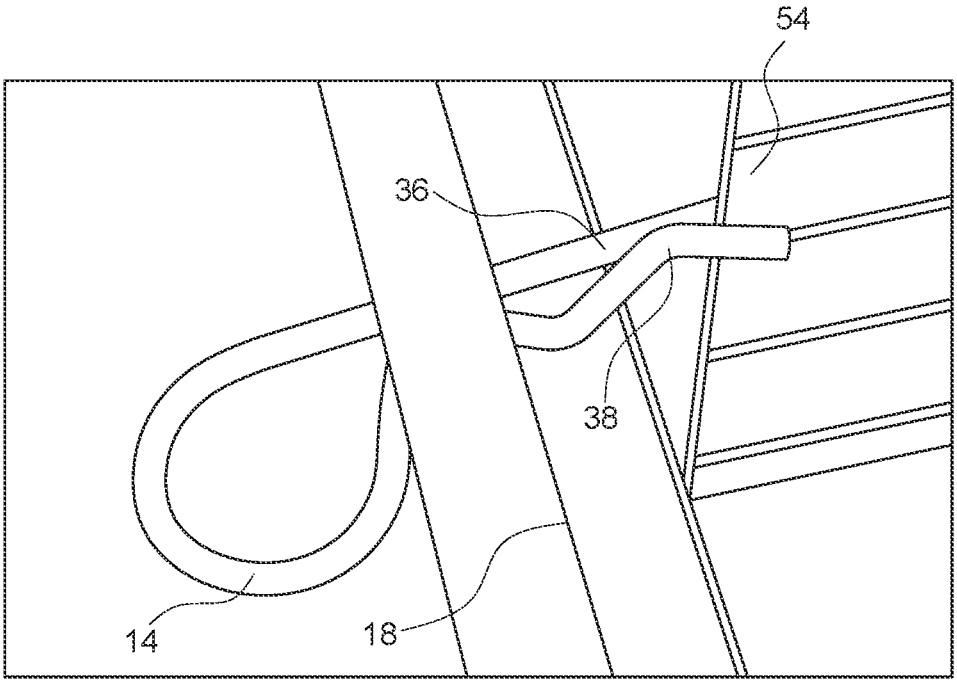
FIG. 7 is another upper perspective view similar to FIG. 6, but showing an opposite side of the clip contacting the center wall.

The vent cover assembly 10 is formed to cover a specific type of crawl space vent 11, illustrated, but not by way of limitation, in FIGS. 4 and 5. The vent 11 includes a perimeter wall 52 and a median-located vertical central wall 54, which forms two separate openings 55, 56 into the vent 11 which form a pair of enclosures 57, 58 within the vent 11 (shown in FIG. 10). The vent 11 also has a pair of rearwardly-located screened areas 60, 62 which provide some closure of openings 55, 56 to rodents and large insects from entering the crawl space. The vent 11 also includes stops 64, 66 positioned within each opening 55, 56 of the vent 11 which are movable into various positions, including a closed position, an opened position, or a partially opened/closed position, as shown in FIGS. 4-5.

The present vent cover assembly 10 is configured to cover a vent 11 having the configuration shown and described herein. It will be understood that the vent 11 has a specific length 68 and a specific width 70. The vent 11 also has a perimeter edge 72 which is usually positioned in a somewhat indented position with respect to an outer surface 75 of a wall 74 of a building 76 (as shown in FIG. 2). However, it will be understood that crawl space vents may vary in shape and size, and that any size vent cover 12 that at least covers an opening in a crawl space vent may be utilized. Therefore, the outer perimeter of the vent cover 12 may include different lengths and widths, as well as different sizes and configurations, and may, if desired by a customer, extend over a small portion of an outer surface 75 of a wall 74.

Similarly, the vent cover 12 is formed to cover the specific outer length and width of the crawl space vents shown in FIGS. 4 and 5. As illustrated in the crawl space vent shown in FIG. 5, the vent cover 12 will desirably include a substantially similar length and width of the crawl space cover 11 to substantially cover an perimeter edge 72 of the vent 11, as illustrated in FIG. 2. However, the present vent cover 12, unlike other vent covers, is not configured to extend over the outer surface 75 of the wall 74 of the building 76. This permits the vent cover 12 to commonly have, but not by way of limitation: a) a flush position relative to an outer surface 75 of a wall 74 of a building 76 when the vent cover 12 is positioned over the vent 11, b) a slightly indented position when the perimeter edge 72 of the vent 11 is more indented into the outer surface 75 of the wall 74, or c) a slightly raised position if the perimeter edge 72 of the vent is slightly raised relative to the outer surface 75 of the wall 74. In this manner, the visually cover 12 blends with the outer surface 73 of the wall 74 of a building 76 to make the building 76 more attractive, and to have more curb appeal.

Figure 8:
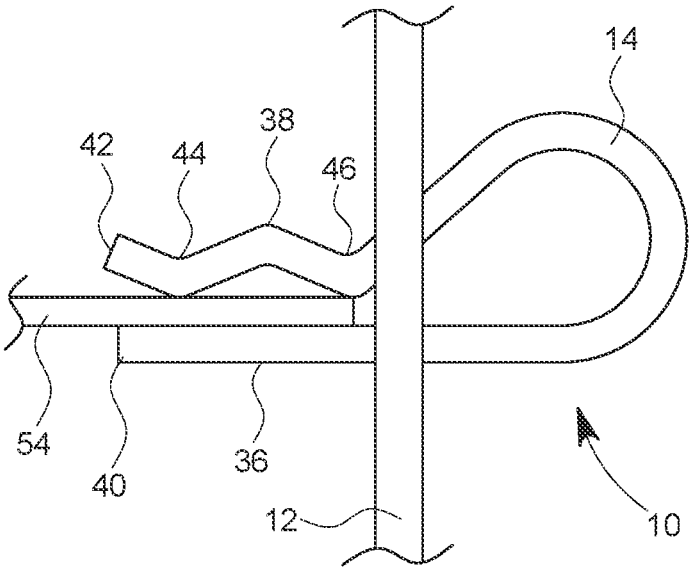
FIG. 8 is a schematic sectional view of the vent cover connected to a crawl space vent of FIG. 2, but illustrating the position of a portion of the vent cover and the clip relative to the center vertical wall of the crawl space vent, and showing the frictional grip of the clip relative to the center vertical wall of the crawl space vent when the vent is closed by the vent cover assembly.

To use the vent cover assembly 10, the clip 14 is inserted into the slit 32. The slit 32 is configured such that only a portion of the ring portion 34 of the clip 14 enters the slit, as illustrated in FIG. 8. The slit 32 of the vent cover 12 is positioned in a horizontal position relative to the first and second elongated edges 22, 23, and the position of the slit 32 in a median section 28 of the vent cover and the configuration of the slit 32 desirably holds the clip in a defined position, such that a portion of the ring portion extends into the slit and is held in a fixed position within a perimeter of the slit, while another portion of the ring portion is configured to extend away from the slit and the outer surface of the vent cover. In the present embodiment, but not by way of limitation in a most desirable method of use, the clip 12 may be positioned in the slit 32 such that the straight leg 36 is positioned on a left side of the slit 32 (illustrated in FIGS. 1 and 6). The straight first leg 36 and the sinusoidal second leg 36, 38, respectively, extend beyond the slit 32 and the inner surface 18 of the vent cover 12. The first and second legs extend side-by-side toward the center vertical wall 54 in order to permit at least a portion of the center vertical wall 54 to move between the straight first leg 36 and the sinusoidal second leg 38. With the clip 14 in this position, the vent cover 12 is moved in front of the vent 11 and the center vertical wall 54. The clip 14 is moved such that the end 40 of the straight first leg 36 and the end 42 of the sinusoidal second leg 38, respectively, are each positioned on one side of the vertical center wall 54, to hold the vertical center wall 54. The clip 14 is pushed forward while simultaneously the vent cover 12 is positioned over the perimeter edge 72 of the vent 11 to cover the perimeter edge while the vertical center wall 54 is held in a frictional grip between the straight first leg 36 and the sinusoidal second leg 38, respectively.

It will be appreciated that the present vent cover assembly 10 of the vent 11 uses merely a frictional grip by the clip 14 with the vertical center wall 54 of the vent 11. Such a frictional grip is equivalent to holding, gripping, or clasping an object between a finger and a thumb. The clip 14 has no mechanical parts overlapping, interlocking, engaging together, and the like, with the center wall or any components of the vent 11 or the vent cover assembly. In addition, because the vent cover 12 includes a desired low profile when positioned against the perimeter edge 72 of the vent 11, only a frictional grip by the clip 14 onto the vertical center wall 54 of the vent 11 is needed to securely but easily hold the vent cover assembly in the desired position. Therefore, the vent cover 12 is frictionally gripped into the vent 12 at only one area via the clip 14.

Similarly, to remove the vent cover assembly 10 from the vent 11, a user only pulls the ring portion 34 of the clip 14 to pull the clip 14 (and straight leg 36 and sinusoidal second leg 38 thereof) which also moves the away from the vertical center wall 54 of the vent 11. The vent cover 12 and the clip 14 easily move away from the vent 11 due to the use of only a frictional grip by the clip 14 to the vertical center wall 54 of the vent 11.

Figure 9A:
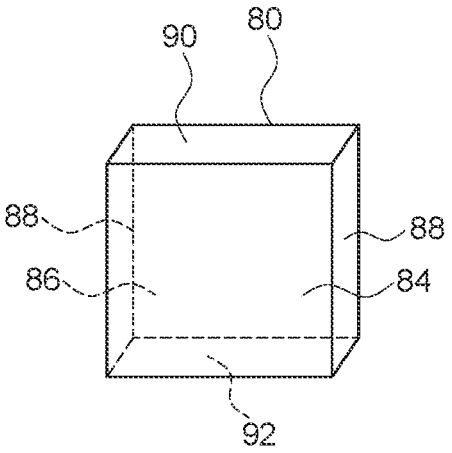
FIGS. 9A and 9B are schematic perspective views of a pair of vent fillers in accordance with the present invention.
Figure 9B:
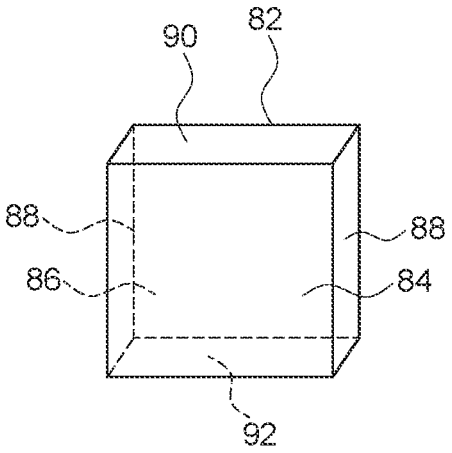

A vent filler may also be used with the vent cover assembly 10 in order to further insulate the crawl space in cold or hot weather. The vent filler may or may not be attached to vent cover assembly 10 in any practical manner (glue or otherwise). As schematically illustrated in FIGS. 9A and 9B, a pair of vent fillers are illustrated. Each vent filler 80, 82 includes a front surface 84, a rear surface 86 (shown in phantom lines), opposing side surfaces 88 (one illustrated in phantom lines), a top surface 90 and a bottom surface 92 (illustrated in phantom lines). Ideally, each vent filler 80, 82 substantially conforms to each enclosure 57, 58 of the vent 11 (FIG. 10), and does not extend outward from the vent beyond the perimeter or front edge 72 of the vent 11. In one embodiment, for example but not by way of limitation, the vent fillers 80, 82 each have a height of 7¼ inches, a length of 7.9 inches (per FIG. 4: 15⅞ inches less 1/16 inches (the width of the vertical center wall 54) divided by 2, and a depth between ⅝ inches and 4¾ inches (the depth of each enclosure 57 and 58.

Figure 10:
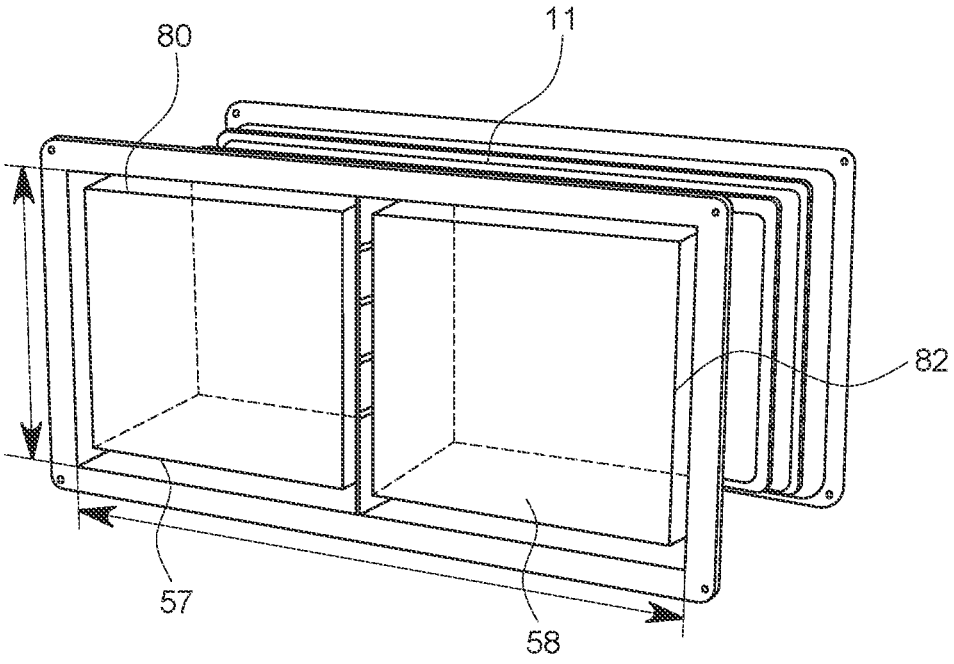
FIG. 10 is a schematic perspective view of the vent fillers of FIG. 9 inserted into the vent of FIG. 4 showing that the pair of vent fillers do not extend beyond an outer perimeter of the vent.

The pair of vent fillers 80, 82 may be any thickness. That is, a thickness of the vent filler may be sufficient to fill the vent 11, or the vent fillers 80, 82 may be thinner to provide extra protection against moisture, such as rain, from gaining access to the vent 11 from the surrounding outer surface 75 of the building 76. The vent fillers 80, 82 may be made from polystyrene, rubber, plastics, Styrofoam or any material or combination of materials that permits the vent fillers to perform as shown and described herein. FIG. 10 illustrates schematically the vent fillers 80, 82 positioned inside of each enclosure 57, 58 of the vent 11 shown previously in FIG. 4.

As used herein, the term "median" means situated in or relating to the middle of an object).

As used herein, the terms "engage", or "couple", or "connect", or "interlock" mean to interweave or interlace, one part with another part.

As used herein, the term "frictional grip" means to grasp or sere firmly, such as by gripping an object between a finger and thumb; the term does not mean to engage, to couple, to connect, or to interlock, as those terms are defined herein.

As used herein, the term "substantially" relative to the vent fillers 80, 82 described herein, means that at least one vent filler may fill at least one enclosure 57, 58, of the pair of enclosures 57, 58, by at least 80 percent (within a range of plus or minus 5 percent of the 80 percent) without extending outward beyond an outer perimeter 72 of the vent 11. More desirably, at least one vent filler 80, 82 may fill at least one enclosure 57, 58 of the pair of enclosures 57, 58, by at least 90 percent (within a range of plus or minus 5 percent of the 90 percent) without extending outward beyond an outer perimeter 72 thereof.

As used herein, the phrase "the vent cover configured to extend over but not substantially beyond the outer perimeter of the vent" means that the vent cover does not extend more than 5 percent beyond the outer perimeter of the vent. Similarly, as used herein, the phrase "the vent cover 12 will desirably include a substantially similar length and width of the crawl space cover 11 to substantially cover an perimeter edge 72 of the vent 11" also means that the vent cover does not extend more than 5 percent beyond the outer perimeter of the vent.

Therefore, the foregoing is considered as illustrative only of the principles of the disclosure. Further, since numerous modifications and changes will readily occur to those of ordinary skill in the art, it is not desired to limit the disclosure to the exact construction and operation shown and described, and accordingly, all suitable modifications and equivalents may be resorted to, falling within the scope of the disclosure.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A vent cover assembly adapted to cover a crawl space vent, the vent cover assembly comprising:

a vent cover having an outer surface, an inner surface, and a perimeter edge that extends around the vent cover, the vent cover including a slit positioned in and extending through the vent cover between the outer surface and the inner surface, the slit positioned in a median position of the vent cover; and a planar clip having a ring portion and a first leg and a second leg extending from the ring portion, the first leg and the second leg both configured to be slidably inserted through the slit of the vent cover, while only a portion of the ring portion is configured to extend therethough;

wherein when the vent cover assembly is positioned in front of a vent and the clip is inserted into the slit, a portion of the ring portion extends into the slit and is held in a fixed position within a perimeter of the slit, while another portion of the ring portion is configured to extend away from the slit and the outer surface of the vent cover, the first leg and the second leg configured to extend through the slit and a distance away from the inner surface of the vent cover, and wherein the first leg and the second leg of the clip are positioned to receive therebetween a portion of a vertically positioned central wall of the vent, and when the vent cover is moved in alignment with an outer perimeter of the vent, the first leg and the second leg of the clip are pushed over each side of a portion of the center wall so that the portion of the center wall is positioned between the first leg and the second leg, at least a portion of the first leg and at least a portion of the second leg configured to frictionally grip each side of the portion of the central wall firmly but releasably therebetween, the inner surface of the vent cover positioned against an outer peripheral edge of the vent to cover the vent, the clip holding the vent cover in a closed position over the vent, and the vent cover configured to extend over but not substantially beyond the outer perimeter of the vent.

2. The vent cover assembly of claim 1, wherein the perimeter of the vent cover includes a first elongated edge and a second elongated edge positioned parallel relative to each other, a first end edge and a second end edge positioned parallel relative to each other, the slit positioned parallel to the first elongated edge and the second elongated edge.

3. The vent cover assembly of claim 2, wherein the clip is positioned in the slit such that the ring portion extending a distance from the outer surface of the vent cover is parallel to the first elongated edge and the second elongated edge of the vent cover.

4. The vent cover assembly of claim 3, wherein the portion of the first leg is a straight portion and the portion of the second leg is sinusoidally shaped and formed to include at least one v-shaped portion, and wherein the ring portion urges the first leg and the second leg toward each other.

5. The vent cover assembly of claim 4, wherein the straight portion of the first leg and the at least one v-shaped portion of the second leg frictionally grip the central wall of the vent when the central wall is positioned therebetween.

6. The vent cover assembly of claim 5, wherein no portion of the clip interlocks with a portion of the vent.

7. The vent cover assembly of claim 5, wherein the first leg and the second leg includes a first end and a second end, respectively, and the at least one end of the first end and the second end is spaced away from the other to receive the central wall between the first end and the second end.

8. The vent cover assembly of claim 1, wherein the vent cover is formed from an environmentally friendly material certified by at least one certification authority, and wherein the vent cover is formed from a solid and non-metallic material.

9. The vent cover assembly of claim 1, wherein the vent cover assembly further includes at least one vent filler.

10. The vent cover assembly of claim 1, wherein the vent cover assembly is removable from the vent when the ring portion of the clip is pulled away from the vent, which moves the first leg and the second leg away from the vertical central wall to release the frictional grip thereon, and simultaneously moves the vent cover away from the vent.

11. A method of applying a vent cover assembly to a crawl space vent, the method comprising:

providing a vent cover assembly which includes a vent cover having an outer surface, an inner surface and a perimeter edge extending around the vent cover, the vent cover including a slit positioned in a median area and extending through the vent cover between the outer surface and the inner surface, the vent cover assembly also including a planar clip having a ring portion and a first leg and a second leg, a first portion of the ring portion and the first leg and the second leg both configured to be slidably inserted through the slit;

positioning the vent cover in front of a crawl space vent having a center vertical wall, inserting the clip into the slit, the first portion of the ring portion configured to extend into the slit and is held in a fixed position, and a second portion of the ring portion configured to extend away from the slit and the outer surface of the vent cover, the first leg and second leg extending through and a distance away from the slit and the inner surface of the vent cover;

contacting a front edge of a vertical center wall of the vent with the first leg and the second leg;

aligning the vent cover with an outer perimeter of the vent;

pushing the clip and the vent cover toward the vent simultaneously, such that the central wall is received between the first leg and the second leg, the first leg and the second leg being urged by the ring portion toward each other such that the first leg and the second leg are frictionally gripping the center wall wherein the inner surface of the vent cover is moved against the outer peripheral edge of the vent to cover the vent, the vent cover configured to not extend substantially beyond the vent.

12. The method of claim 11, wherein in the step of providing a vent cover assembly, the outer perimeter of the vent cover further includes a first elongated edge, and a second elongated edge positioned parallel relative to each other, a first end edge and a second end edge positioned parallel relative to each other, and the slit is formed in a median area of the vent cover, and the slit is parallel relative to the first elongated edge and the second elongated edge.

13. The method of claim 12, wherein the clip is positioned in the slit such that the ring portion is positioned parallel to the first elongated edge and the second elongated edge of the vent cover.

14. The method of claim 11, wherein a portion of the first leg is a straight portion and a portion of the second leg is sinusoidally shaped and formed to include at least one v-shaped portion.

15. The method of claim 14, wherein the straight portion of the first leg and the at least one v-shaped portion of the second leg frictionally grip the center wall of the vent when the center wall is positioned therebetween.

16. The method of claim 15, wherein no portion of the clip interlocks with a portion of the vent.

17. The method of claim 15, wherein the first leg and the second leg include a first end and a second end, respectively, and at least one end of the first end and the second end is spaced away relative to the other to receive the central wall between the first and the second end.

18. The method of claim 11, wherein in the step of providing a vent cover assembly, the vent cover is formed from an environmentally friendly material certified by at least one certification authority, and wherein the vent cover is formed from a solid and non-metallic material.

19. The method of claim 18, wherein the vent cover assembly further includes at least one vent filler.

20. The method of claim 11, wherein the method further includes the step of removing the vent cover assembly from the vent by pulling the ring portion of the clip positioned on the outer surface of the vent cover away from the vent, and slidably moving the first leg and the second leg away from the central wall to release the frictional grip thereon, such that moving the clip results in simultaneously moving the vent cover away from the vent.

* * * * *